US007841590B2

(12) United States Patent
Adachi et al.

(10) Patent No.: US 7,841,590 B2
(45) Date of Patent: Nov. 30, 2010

(54) MEDIUM FEEDING UNIT AND IMAGE FORMING APPARATUS

(75) Inventors: Yuichi Adachi, Kanagawa (JP); Yoshiaki Watanabe, Kanagawa (JP); Mitsuhiro Nakamura, Kanagawa (JP); Yoshiyuki Kitazawa, Kanagawa (JP)

(73) Assignee: Fuji Xerox Co., Ltd., Tokyo (JP)

( * ) Notice: Subject to any disclaimer, the term of this patent is extended or adjusted under 35 U.S.C. 154(b) by 51 days.

(21) Appl. No.: 12/408,228

(22) Filed: Mar. 20, 2009

(65) Prior Publication Data

US 2009/0243187 A1 Oct. 1, 2009

(30) Foreign Application Priority Data

Mar. 25, 2008 (JP) ..... P2008-079001

(51) Int. Cl.
*B65H 3/44* (2006.01)
*B65H 5/26* (2006.01)

(52) U.S. Cl. ..... 271/9.09; 271/9.01; 271/9.11; 271/9.12; 271/9.13

(58) Field of Classification Search ..... 271/9.01, 271/9.09, 9.11, 9.12, 9.13
See application file for complete search history.

(56) References Cited

U.S. PATENT DOCUMENTS 4,066,253 A * 1/1978 Lundbald et al. ..... 271/4.02
4,849,790 A * 7/1989 Ito ..... 399/367
5,203,552 A 4/1993 Hoshi et al.
5,240,238 A * 8/1993 Lee ..... 271/9.11
5,368,285 A * 11/1994 Kusumoto ..... 271/9.01
6,039,314 A * 3/2000 Miller et al. ..... 271/9.01
7,669,844 B2 * 3/2010 Ohgita et al. ..... 271/9.01
2005/0082737 A1 * 4/2005 Sasaki et al. ..... 271/9.12
2007/0296135 A1 12/2007 Takahagi et al.
2009/0256303 A1 * 10/2009 Adachi et al. ..... 271/9.01

FOREIGN PATENT DOCUMENTS

JP 63087440 A * 4/1988
JP 3-182440 8/1991
JP 2003-095455 A 3/2003
JP 2005-121886 A 5/2005
JP 2005-145623 A 9/2005
JP 2007-284188 A 1/2007
JP 2007-320755 A 12/2007

* cited by examiner

*Primary Examiner*—Patrick Mackey
*Assistant Examiner*—Prasad V Gokhale
(74) *Attorney, Agent, or Firm*—Morgan, Lewis & Bockius LLP

(57) ABSTRACT

An image forming apparatus includes: a first feeding unit and a second feeding unit. In the first feeding unit, a hand-feeding unit having a hand-feeding accommodating portion is mounted. The first feeding unit includes a first mounting portion into which a medium is conveyed from the hand-feeding accommodating portion. And a connection unit for consecutive installation is mounted to the first mounting portion in a state where the hand-feeding unit is removed from the first mounting portion. The connection unit includes an added conveyance path for consecutive installation. The second feeding unit includes a second mounting portion in which the hand-feeding unit is mounted and into which a medium is conveyed from the hand-feeding accommodating portion. And the second feeding unit is connected to the added conveyance path.

5 Claims, 12 Drawing Sheets

MEDIUM FEEDING UNIT AND IMAGE FORMING APPARATUS

CROSS-REFERENCE TO RELATED APPLICATIONS

This application is based on and claims priority under 35 USC 119 from Japanese Patent Application No. 2008-079001 filed Mar. 25, 2008.

BACKGROUND

Technical Field

The present invention relates to a medium feeding unit and an image forming apparatus.

SUMMARY

According to an aspect of the invention, an image forming apparatus, includes an image recording device that includes a carrying-in path into which a medium is carried in and forms an image on the medium; a first feeding unit comprising: a first accommodating portion that accommodates a medium; a first conveyance path that extends from the first accommodating portion and is connected to the carrying-in path, the medium from the first accommodating portion being conveyed to the first conveyance path; a first mounting portion that includes a first hand-feeding conveyance path, where a hand-feeding unit is detachably mounted to the first mounting portion, the hand-feeding unit comprises a hand-feeding accommodating portion in which a hand-fed medium is to be accommodated, and the first hand-feeding conveyance path connects the hand-feeding accommodating portion and the carrying-in path for conveying a medium from the hand-feeding accommodating portion; a connection unit for consecutive installation, that is configured to be detachably mounted to the first mounting portion in a state where the hand-feeding unit is removed from the first mounting portion, and includes an added conveyance path therein for consecutive installation to be connected to the first hand-feeding conveyance path; and a second feeding unit comprising: a second accommodating portion that accommodates a medium; a second conveyance path that extends from the second accommodating portion and is connected to the added conveyance path for conveying the medium from the second accommodating portion; and a second mounting portion that includes a second hand-feeding conveyance path, where the hand-feeding unit removed from the first mounting portion is detachably mounted to the second mounting portion, the second hand-feeding conveyance path is connected to the added conveyance path for conveying a medium from the hand-feeding accommodating portion.

BRIEF DESCRIPTION OF THE DRAWINGS

Exemplary embodiment(s) of the present invention will be described in detail based on the following figures, wherein:

FIG. 8A is an enlarged view showing the parts in a state where a detaching projection portion is drawn out from the unit mounting hole, and FIG. 8B is an enlarged view showing the parts in a state where the detaching projection portion is mounted in the unit mounting hole;

DETAILED DESCRIPTION

Figure 1:
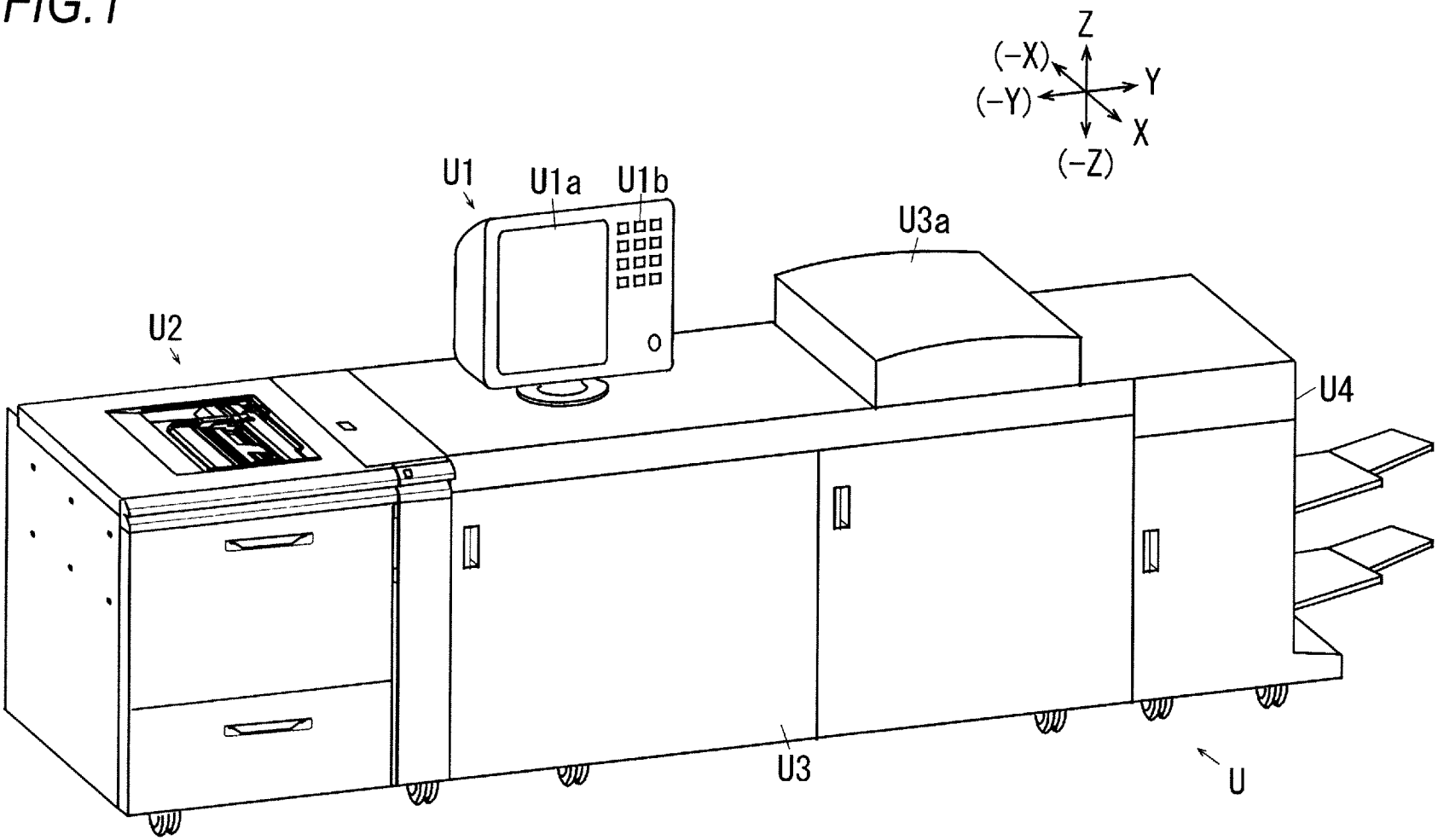
FIG. 1 is a perspective view showing an image forming apparatus according to exemplary embodiment 1 of the present invention.

Next, a description is given for the detailed exemplary embodiments of the present invention with reference to the drawings. However, the present invention is not limited to the following exemplary embodiments.

Also, to facilitate understanding of the description below, in the drawings, it is assumed that the front and back direction is the X-axis direction, the left and right direction is the Y-axis direction, the up and down direction is the Z-axis direction, and the directions or sides shown by arrows X, −X, Y, −Y, Z, and −Z are, respectively, forward, backward, rightward, leftward, upward, downward, or front side, back side, right side, left side, upper side, and lower side.

In addition, a symbol composed of a circle having [.] marked therein means the arrow directed from the back of the paper to the front thereof, and a symbol composed of a circle having [x] marked therein means the arrow directed from the front of the paper to the back thereof.

Further, in the description using the following drawings, parts other than the configuration and members required for the description are appropriately omitted to facilitate understanding.

Exemplary Embodiment 1

(Description of Image Forming Apparatus)

Figure 2:
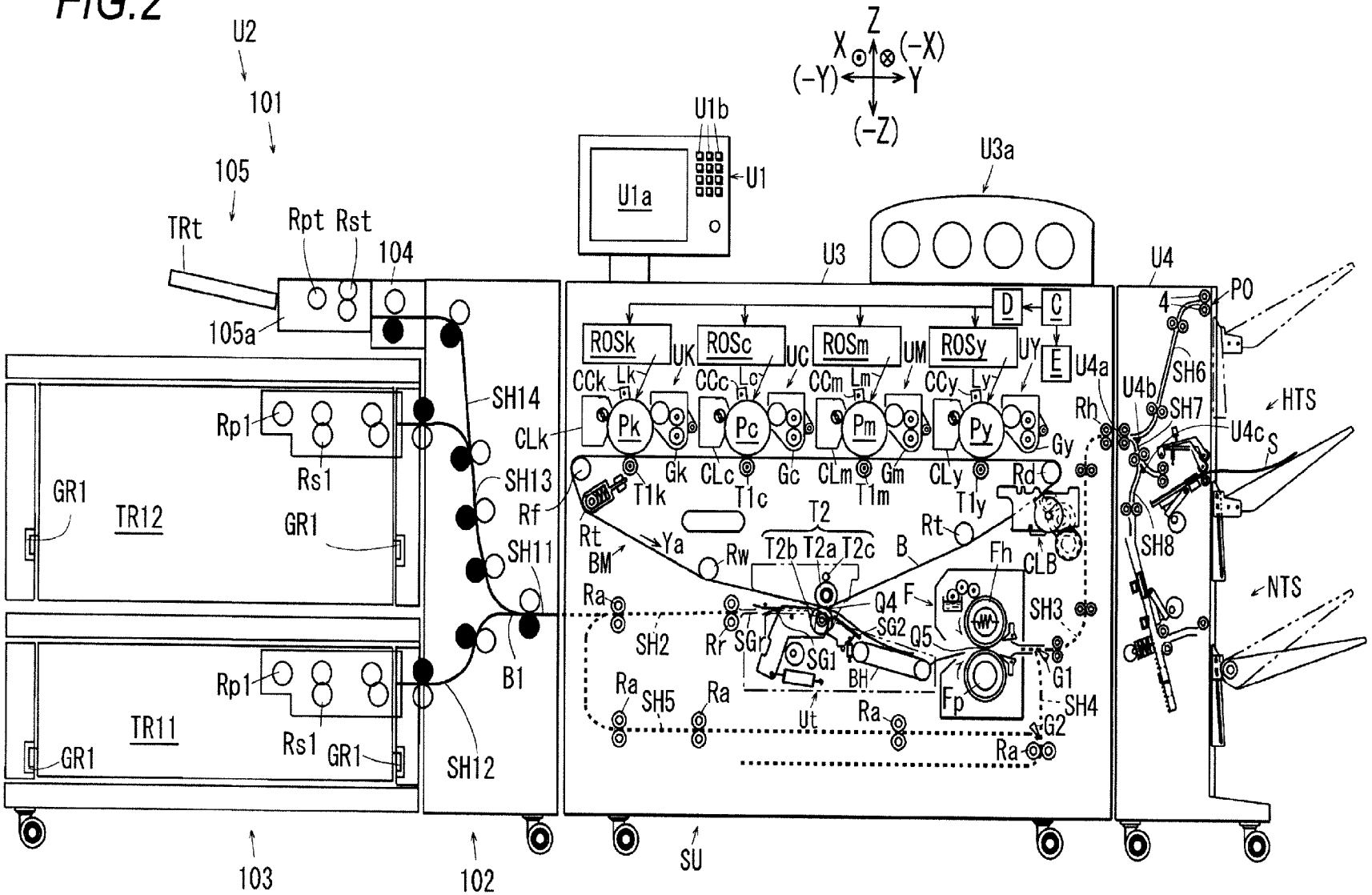
FIG. 2 is a schematic view showing the entirety of the image forming apparatus according to exemplary embodiment 1 of the present invention.

FIG. 1 is a perspective view of an image forming apparatus according to Exemplary embodiment 1 of the present invention;

FIG. 2 is a schematic view showing the entirety of the image forming apparatus according to exemplary embodiment 1 of the present invention;

In FIG. 1 and FIG. 2, a large-sized printer U as an example of the image forming apparatus is provided with an operation portion U1 to operate the printer U, a sheet feeding unit U2 as an example of a medium feeding unit, an image forming apparatus main body U3 as an example of an image recording portion, and a post-processing unit U4.

The operation portion U1 includes a display portion U1*a* to display information and an input button U1*b* to carry out various types of setting of the image forming apparatus.

The sheet feeding unit U2 feeds recording sheets S, which are as an example of a medium accommodated therein, to the image forming apparatus main body U3.

In FIG. 2, the image forming apparatus main body U3 has a control portion C to control the printer U, a latent image forming device drive circuit D controlled by the control portion C, and a power source circuit E, etc. The latent image forming device drive circuit D the operation of which is controlled by the control portion C prepares image information of respective colors of yellow, magenta, cyan and black based on image information transmitted from an information terminal (not illustrated), and outputs drive signals responsive thereto to latent image forming devices ROSy, ROSm, ROSc, and ROSk of visual image forming devices UY, UM, UC and UK of respective colors at predetermined timing. Further, the visual image forming devices UY, UM, UC and UK of respective colors are movably supported between a drawn-out position where the respective devices are drawn out forward of the image forming apparatus main body U3 and a mounted position where the respective devices are internally mounted in the image forming apparatus main body U3.

In the black visual image forming device UK, a charger CCk, a development unit Gk, and a cleaner CLk of an image retainer are disposed around the image retainer Pk.

And, chargers CCy, CCm and CCc, development units Gy, Gm and Gc, and cleaners CLy, CLm and CLc of image retainers are disposed around image retainers Py, Pm and Pc of the other visual image forming devices UY, UM and UC as around the image retainer Pk.

In FIG. 2, after the image retainers Py, Pm, Pc, and Pk are uniformly charged by the chargers CCy, CCm, CCc and CCk, electrostatic latent images are formed on the surfaces thereof by latent image writing light Ly, Lm, Lc and Lk output by the latent image forming devices ROSy, ROSm, ROSc, and ROSk. The electrostatic latent images on the surface of the image retainers Py, Pm, Pc and Pk are developed to visual images of yellow, magenta, cyan and black, so-called toner images by the development units Gy, Gm, Gc and Gk. Further, as developers of the development units Gy through Gk are consumed by development, the developers are supplemented from the developer supplementing device U3*a* disposed on the upper part of the image forming apparatus main body U3. As a developer supplementing container (not shown), a so-called toner cartridge is detachably supported in the developer supplementing unit U3*a* so as to be replaced.

Visual images on the surface of the image retainers Py, Pm, Pc and Pk are overlapped and transferred, one after another, onto an intermediate transfer belt B as an example of an intermediate transfer body by a primary transfer members T1*y*, T1*m*, T1*c* and T1*k* as an example of a primary transfer unit, and a multi-color image is formed on the intermediate transfer belt B. The multi-color image formed on the intermediate transfer belt B is conveyed to the secondary transfer area Q4.

Also, in a case of only a monochrome image, only the image retainer Pk of black K and the development unit Gk thereof are used, and only a black visual image is formed.

After the primary transfer is finished, the remaining substances (residues) on the surface of the image retainers Py, Pm, Pc and Pk are removed and cleaned by the cleaners CLy, CLm, CLc and CLk of the image retainers.

The intermediate transfer belt B is rotatably supported in the direction of the arrow Ya by an intermediate transfer body drive member Rd, a tension generating member Rt, a skew prevention member Rw, a plurality of driven members Rf and secondary transfer opposing members T2*a*, and the primary transfer members T1*y*, T1*m*, T1*c* and T1*k*. In exemplary embodiment 1, the respective members Rd, Rt, Rw, Rf, T2*a*, and T1*y* through T1*k* are composed of so-called roll-shaped members.

A secondary transfer unit Ut is disposed downward of a backup roll T2*a* as an example of the secondary transfer opposing member. The secondary transfer member T2*b* of the secondary transfer unit Ut is disposed so as to be brought into contact with and separated from the backup roll T2*a* with the intermediate transfer belt B placed therebetween, and the area at which the secondary transfer roll T2*b* is brought into contact with the intermediate transfer belt B under pressure forms the secondary transfer area Q4. Further, in exemplary embodiment 1, a conductive contacting member T2*c* is brought into contact with the backup roll T2*a*, and secondary transfer voltage of the same polarity as that of the charging polarity of a developer is applied to the conductive contacting member T2*c* from the power source circuit E controlled by the control portion C at predetermined timing.

The secondary transfer device T2 according to Exemplary embodiment 1 is composed of the secondary transfer opposing member T2*a*, the secondary transfer member T2*b* and the conductive power feeding member T2*c*. The transfer device according to exemplary embodiment 1 is composed of the primary transfer members T1*y* through T1*k*, the intermediate transfer belt B, and the secondary transfer device T2.

A sheet feeding path SH2 as an example of a carrying-in path is disposed downward of the intermediate transfer belt B. A recording sheet S fed from the sheet feeding unit U2 is conveyed to a registration roll Rr as an example of a feed timing adjustment member of the sheet feeding path SH2.

The recording sheet S conveyed to the registration roller Rr is conveyed to the secondary transfer area Q4 passing through a before-transfer upstream side medium guiding member SGr and a before-transfer downstream side medium guiding member SG1 in response to the timing at which a multi-color image is conveyed to the secondary transfer area Q4.

The multi-color image on the intermediate transfer belt B is transferred onto the recording sheet S by the secondary transfer device T2 when passing through the secondary transfer area Q4. Further, in a case of a multi-color image, a primary transferred toner image is collectively secondarily transferred on the recording sheet S while being overlapped on the surface of the intermediate transfer belt B.

The intermediate transfer belt B after secondary transfer is cleaned up by the intermediate transfer body cleaner CLB. Further, the secondary transfer member T2*b* and the intermediate transfer body cleaner CLB are disposed so as to be brought into contact with and separated from the intermediate transfer belt B, and are separated from the intermediate transfer belt B until a non-fixed visual image of the final color is primarily transferred onto the intermediate transfer belt B where a multi-color image is formed.

The recording sheet S on which a non-fixed visual image is secondarily transferred is conveyed to a fixing unit F through the after-transfer medium guiding member SG2 and the medium conveying member BH. The fixing unit F has a heating roll Fh as an example of a heating and fixing member and a pressing roll Fp as an example of a pressing and fixing member, and the recording sheet S is conveyed to a fixing area Q5 in which a pair of fixing rolls Fh and Fp are brought into contact with each other with pressure operated. A non-fixed visual image on the recording sheet S is heated and fixed by the fixing unit F when passing through the fixing area Q5. A change member G1 is provided at the downstream side of the fixing unit F. The change member G1 selectively changes the recording sheet S, which is conveyed through the sheet feeding path SH2, heated and fixed at the fixing area Q5, to either one of the delivery path SH3 side or the turn-over path SH4 side. The recording sheet S conveyed to the delivery path SH3 is delivered from a delivery roll Rh as an example of the delivery member to a post-processing unit U4.

A circulation path SH5 is connected to the turn-over path SH4, and a conveyance direction regulating member G2 is provided at the connection part thereof. The conveyance direction regulating member G2 once causes the recording sheet S, which has been conveyed to the turn-over path SH4, to straightly pass therethrough, conveys the passed recording sheet S in the reverse direction and further conveys it to the circulation path SH5 side. The recording sheet S conveyed to the circulation path SH5 is re-conveyed to the transfer area Q4 through the sheet feeding path SH2.

The medium conveyance path SH is composed of elements shown with reference symbols SH2 through SH5. Also, the medium conveyance unit SU is composed of elements shown with reference symbols SH, Ra, Rr, Rh, SG1, SG2, SGr, BH, G1 and G2.

(Post-Processing Unit U4)

In FIG. 2, a medium carrying-in inlet U4*a* in which a recording sheet S having an image recorded by the image forming apparatus main body U3 is carried is provided at the side where the post-processing unit U4 is connected to the image forming apparatus main body U3. The recording sheet S carried in from the medium carrying-in inlet U4*a* is conveyed to either one of the upper end delivery path SH6 extending right upward or the first post-processing conveyance path SH7 by being changed by the first change member U4*b*. Also, the second post-processing conveyance path SH8 is connected to the first post-processing conveyance path SH7, and the recording sheet S is conveyed to either one of the first post-processing conveyance path SH7 or the second post-processing conveyance path SH8 by the second change member U4*c* disposed at the connection part thereof.

The recording sheet S conveyed to the upper end delivery path SH6 is straightly delivered from the upper end delivery port P0 by the upper end delivery member 4 without being post-processed.

An end binding unit HTS is disposed at the downstream side of the first post-processing conveyance path SH7. The end binding unit HTS executes an end binding process in which a plurality of recording sheets S are stacked and trued up, binding holes are formed at the end portion of a recording sheet bundle and channel-shaped staples are driven into the recording sheet bundle or the recording sheets the ends of which are trued up are delivered without binding.

A center binding unit NTS is disposed at the downstream side of the second post-processing conveyance path SH8. The center binding unit NTS executes a center binding process in which a plurality of recording sheets S are stacked and trued up, are folded in two and delivered after the middle part of recording sheet bundle is bound by channel-shaped staples, or delivered after folding in two without binding.

In addition, the end binding unit HTS and the center binding unit NTS are publicly known techniques. For example, such techniques are described in Japanese Published Unexamined Patent Application Nos. 2003-089462 and 2003-089463. Therefore, a detailed description thereof is omitted.

(Description of Sheet Feeding Unit)

In FIG. 2, the sheet feeding unit U2 has the first feeding unit 101 as an example of the first feeding unit. The first feeding unit 101 includes the first medium conveyance portion 102 disposed adjacent to the image forming apparatus main body U3, a medium feeding portion 103 disposed leftward of the first medium conveyance portion 102, a hand-feeding-unit mounting portion 104 disposed at the first medium conveyance portion 102 side at the upper end of the medium feeding portion 103, and a hand-feeding unit 105 mounted in the hand-feeding-unit mounting portion 104.

A pair of left and right guide rails GR1 as an example of the guiding member are provided in two stages in the medium feeding portion 103, and sheet feeding trays TR11 and TR12 as an example of the accommodating portion are supported so as to be brought in and out in the front and back direction at the guide rail GR1. Recording sheets S accommodated in the sheet feeding trays TR11 and TR12 are taken out by a pickup roll Rp1 being one example of the conveyance members, which is as an example of a send-out member, and separated sheet by sheet by a separation roll Rs1 as an example of a medium separation member. Also, in exemplary embodiment 1, the lower-stage sheet feeding tray TR11 is configured so that the accommodation capacity of recording sheets S thereof is smaller than that of the upper-stage sheet feeding tray TR12.

The hand-feeding unit 105 has a unit main body portion 105*a* attached to the hand-feeding-unit mounting portion 104 and a hand-feeding tray TRt as an example of the hand-feeding accommodating portion supported leftward of the unit main body portion 105*a*. A hand-feeding pickup roll Rpt and a hand-feeding separation roll Rst are installed at the unit main body portion 105*a*. Accordingly, recording sheets S accommodated in the hand-feeding tray TRt are taken out by the hand-feeding pickup roll Rpt and are separated sheet by sheet by the hand-feeding separation roll Rpt.

A confluence feeding path SH11 connected to the sheet feeding path SH2 of the image forming apparatus main body U3 is formed at the first medium conveyance portion 102. A downside feeding path SH12 extending from the sheet feeding tray TR11 and an upside feeding path SH13 extending from the sheet feeding tray TR12 are joined at the confluence portion B1 at the upstream end of the confluence feeding path SH11. In addition, a hand-feeding path SH14 extending from the hand-feeding-unit mounting portion 104 is joined at the upside feeding path SH13. Therefore, recording sheets S fed from the sheet feeding tray TR11 are conveyed through the downside feeding path SH12 and the upside feeding path SH11, and fed to the image forming apparatus main body U3, and recording sheets S fed from the sheet feeding tray TR12 are conveyed through the upside feeding path SH13 and the confluence feeding path SH11 and fed to the image forming apparatus main body U3. Further, recording sheets S fed from the hand-feeding path SH11 are conveyed through the hand-feeding path SH14, upside feeding path SH13 and confluence feeding path SH11, and fed to the image forming apparatus main body U3. In addition, the confluence feeding path SH11 at the first medium conveyance portion 102 are formed upward of the pickup roll Rp1 of the sheet feeding tray TR11 and downward of the pickup roller Rp1 of the sheet feeding tray TR12.

Figure 3:
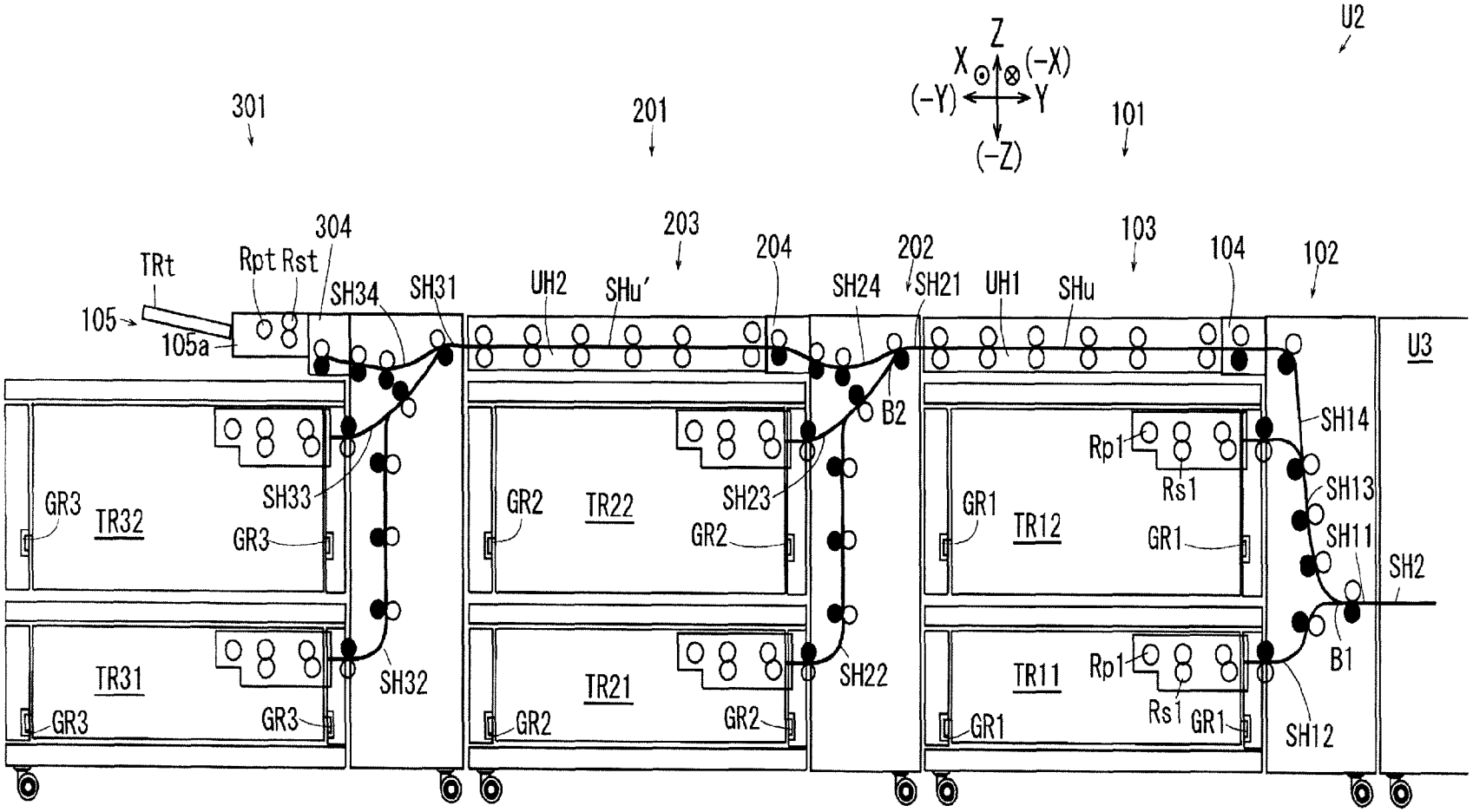
FIG. 3 is a schematic view showing a case where a sheet feeding unit includes a plurality of feeding units.

FIG. 3 is a schematic view showing a case where a sheet feeding unit according to exemplary embodiment 1 has a plurality of feeding units. In FIG. 3, the sheet feeding unit U2 is installed in a state where two feeding units 201 and 301 as an example of the medium feeding unit are connected to the leftward of the first feeding unit 101, with respect to the sheet feeding unit U2 of FIG. 2. That is, the sheet feeding unit U2 has the second feeding unit 201 disposed adjacent to the left side of the first feeding unit 101 and the third feeding unit 301 disposed adjacent to the left side of the second feeding unit 201 in addition to the first feeding unit 101.

Where the second feeding unit 201 is disposed, the hand-feeding unit 105 is removed from the hand-feeding-unit mounting portion 104 of the first feeding unit 101, and a conveyance path connection unit UH1 is mounted, which is as an example of a connection unit for consecutive installation having a connection conveyance path SHu as an example of the added conveyance path for consecutive installation. The downstream side of the connection conveyance path SHu is connected to the hand-feeding path SH14.

The second feeding unit 201 includes the second medium conveyance portion 102 disposed adjacent to the first feeding unit 101, a medium feeding portion 203 constructed so as to be similar to the medium feeding portion 103, and a hand-feeding-unit mounting portion 204 constructed so as to be similar to the hand-feeding-unit mounting portion 104, and a conveyance path connection unit UH2 that is similar to the conveyance path connection unit UH1 is mounted in the hand-feeding-unit mounting portion 204.

A confluence feeding path SH21 connected to the conveyance path connection unit UH1, which is mounted in the hand-feeding-unit mounting portion 104 of the first feeding unit 101, is formed at the second medium conveyance path 203. A hand-feeding path SH24 extending from the hand-feeding-unit mounting portion 204 and an upside feeding path SH23 extending from the sheet feeding tray TR22 are joined at the confluence portion B2 at the upstream end of the confluence feeding path SH21. Also, a downside feeding path SH22 extending from the sheet feeding tray TR21 is joined to the upside feeding path SH23. In addition, the confluence feeding path SH21 at the second medium conveyance portion 203 is formed on the upper part of the second medium conveyance portion 203.

Since the third feeding unit 301 has a configuration similar to that of the second feeding unit 201 except that a hand-feeding unit 105 is mounted at the hand-feeding-unit mounting portion 204 instead of the conveyance path connection unit UH2, detailed description thereof is omitted.

Figure 4:
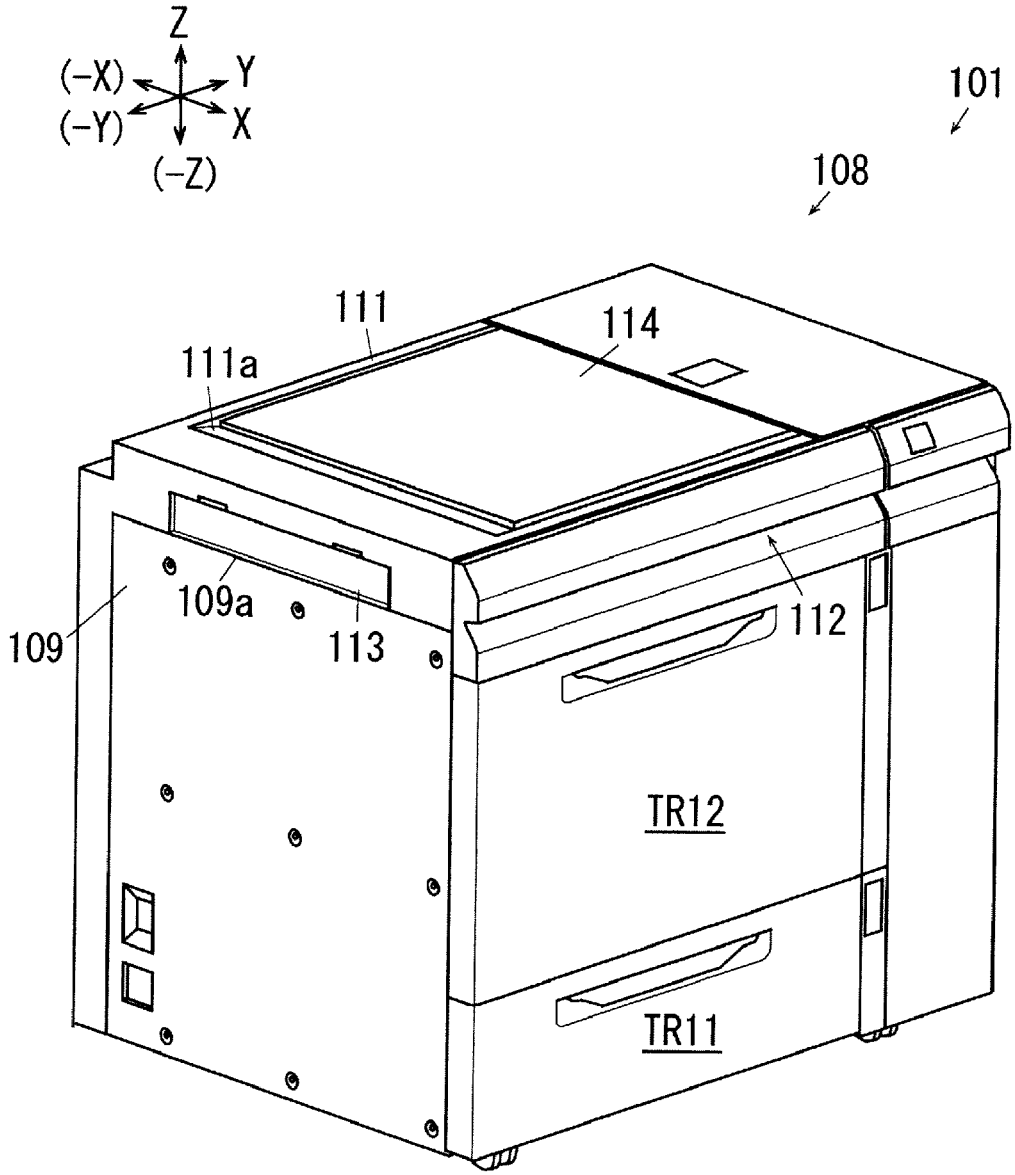
FIG. 4 is a perspective view of the first feeding unit.

FIG. 4 is a perspective view showing the first feeding unit.

In FIG. 4, the first feeding unit 101 has a main body cover 108 as an example of a unit shielding member. The main body cover 108 includes a left cover 109 as an example of a shielding member, an upper cover 111, and an upper front cover 112 that shields the upper front side of the sheet feeding tray TR12. A medium passing hole that is long in the front and back direction is formed at the upper part of the left cover 109. A passing hole cover 113 as an example of the passing hole shielding member is detachably mounted at the medium passing hole 109*a*. Further, a unit accommodating hole 111*a* is formed, corresponding to the hand-feeding-unit mounting portion 104, at the upper cover 111. A unit accommodating hole cover 114 as an example of the unit accommodating hole shielding member is detachably attached to the unit accommodating hole 111*a*. The upper front cover 112 is detachably mounted to the first feeding unit 101.

Figure 5:
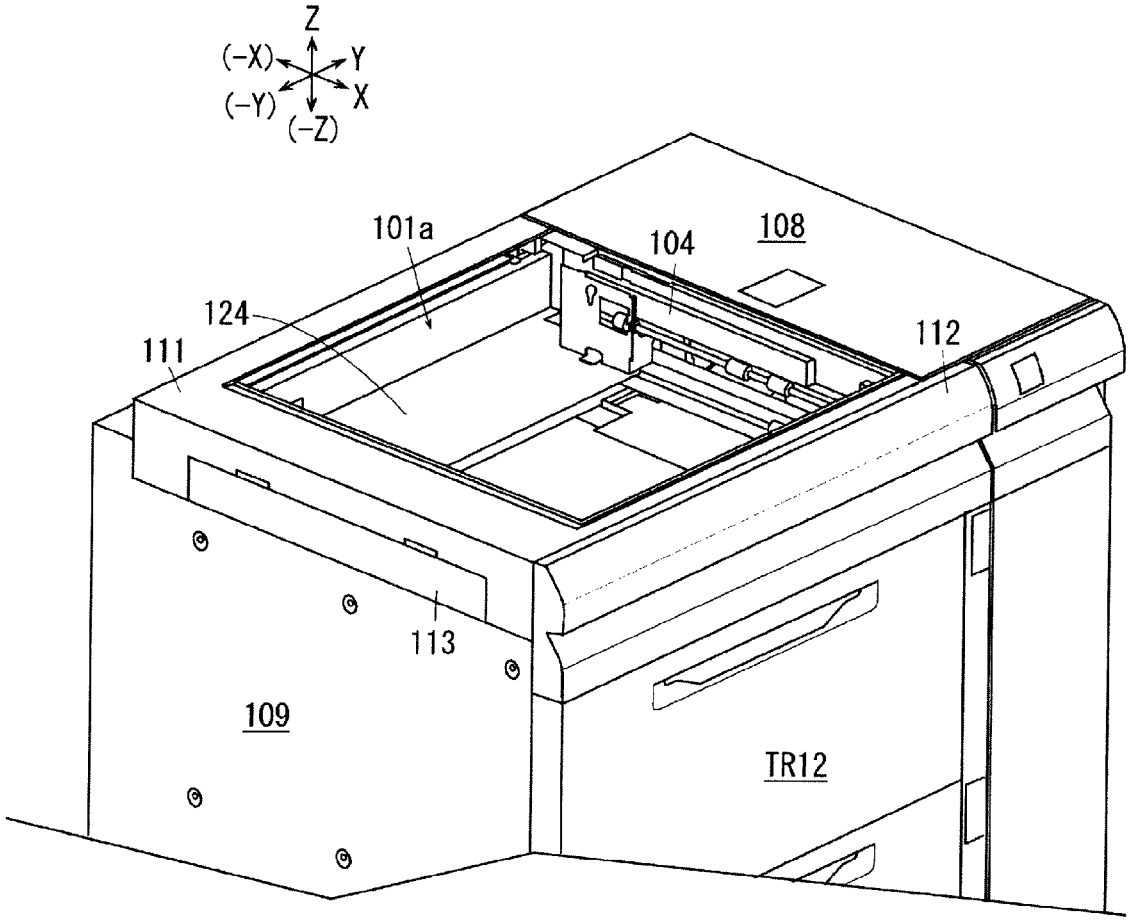
FIG. 5 is a schematic view showing a state where a unit accommodating hole cover is removed from the first feeding unit.

FIG. 5 is a schematic view showing a state where the unit accommodating hole cover is removed from the first feeding unit.

Figure 6:
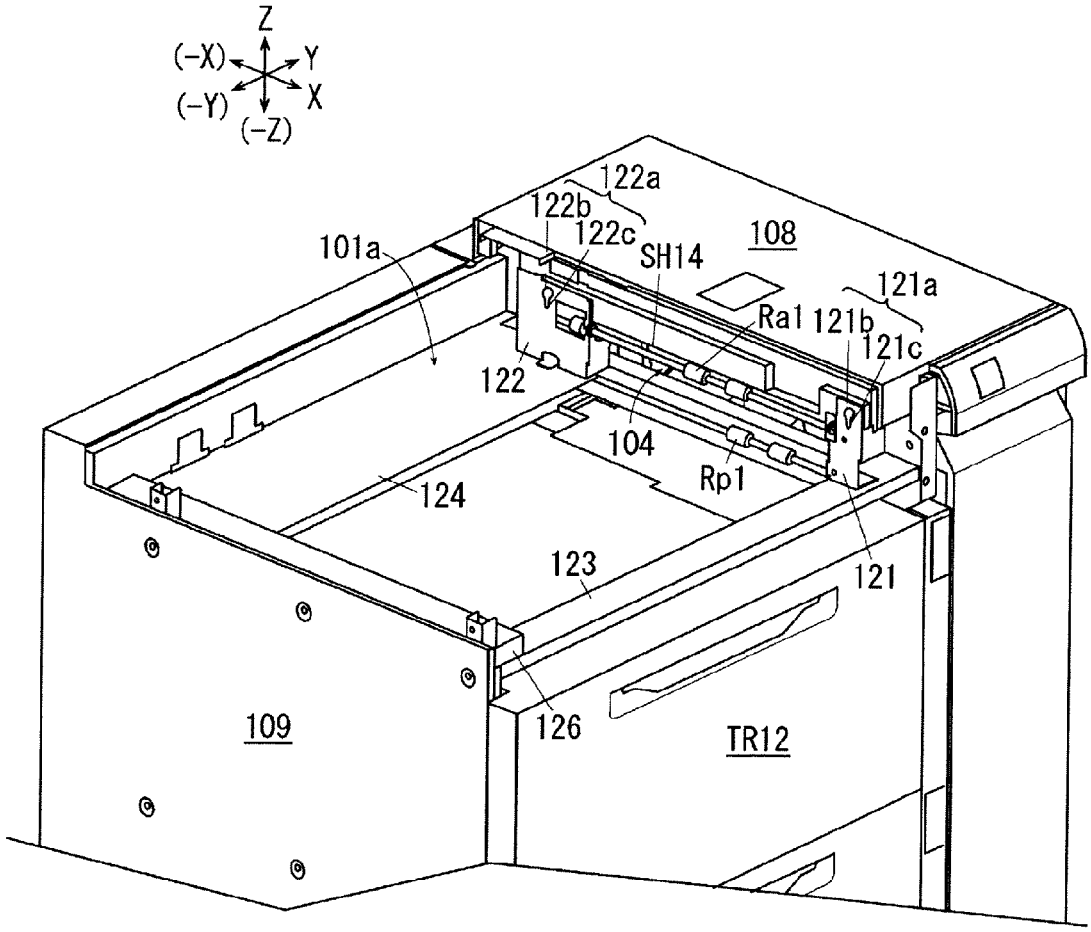
FIG. 6 is a schematic view showing a state where an upper cover, a passing hole cover and an upper front cover are further removed from the first feeding unit in FIG. 5.

FIG. 6 is a schematic view showing a state where the upper cover, the passing hole cover and the upper front cover are further removed from the first feeding unit of FIG. 5.

In FIG. 5 and FIG. 6, a pair of a front side unit mounting plate 121 and a backside unit mounting plate 122 are supported at the left end of the hand-feeding-unit mounting portion 104. In FIG. 6, a front side unit mounting hole 121*a* is formed in the front side unit mounting plate 121. The front side unit mounting hole 121*a* includes a circular detaching hole portion 121*b* and a slot-shaped supporting hole portion 121*c* that is formed consecutively to the lower end of the detaching hole portion 121*b* and has a smaller width than that of the diameter of the detaching hole portion 121*b* and long downward. A unit mounting hole 122*a* having a detaching hole portion 122*b* and a supporting hole portion 122*c* as in the front side unit mounting plate 121 is also formed at the backside unit mounting plate 122. And, a conveyance roll Ra1 is disposed at the upstream end of the hand-feeding path SH14 of the hand-feeding-unit mounting portion 104.

A unit accommodating space 101*a* is formed between the left cover 109 and the hand-feeding-unit mounting portion 104 upward of the sheet feeding tray TR12 in the first feeding unit 101. The front side unit supporting member 123 extending in the left and right direction is supported at the downward front side of the unit accommodating space 101*a*. And, the backside unit supporting member 124 extending in the left and right direction is supported at the downward and backward side of the unit accommodating space 101*a*. A guide member 126 extending forward and backward, which is disposed so as to connect between the front side unit supporting member 123 and the backside unit supporting member 124, is supported at the left lower part of the unit accommodating space 101*a*.

Figure 7:
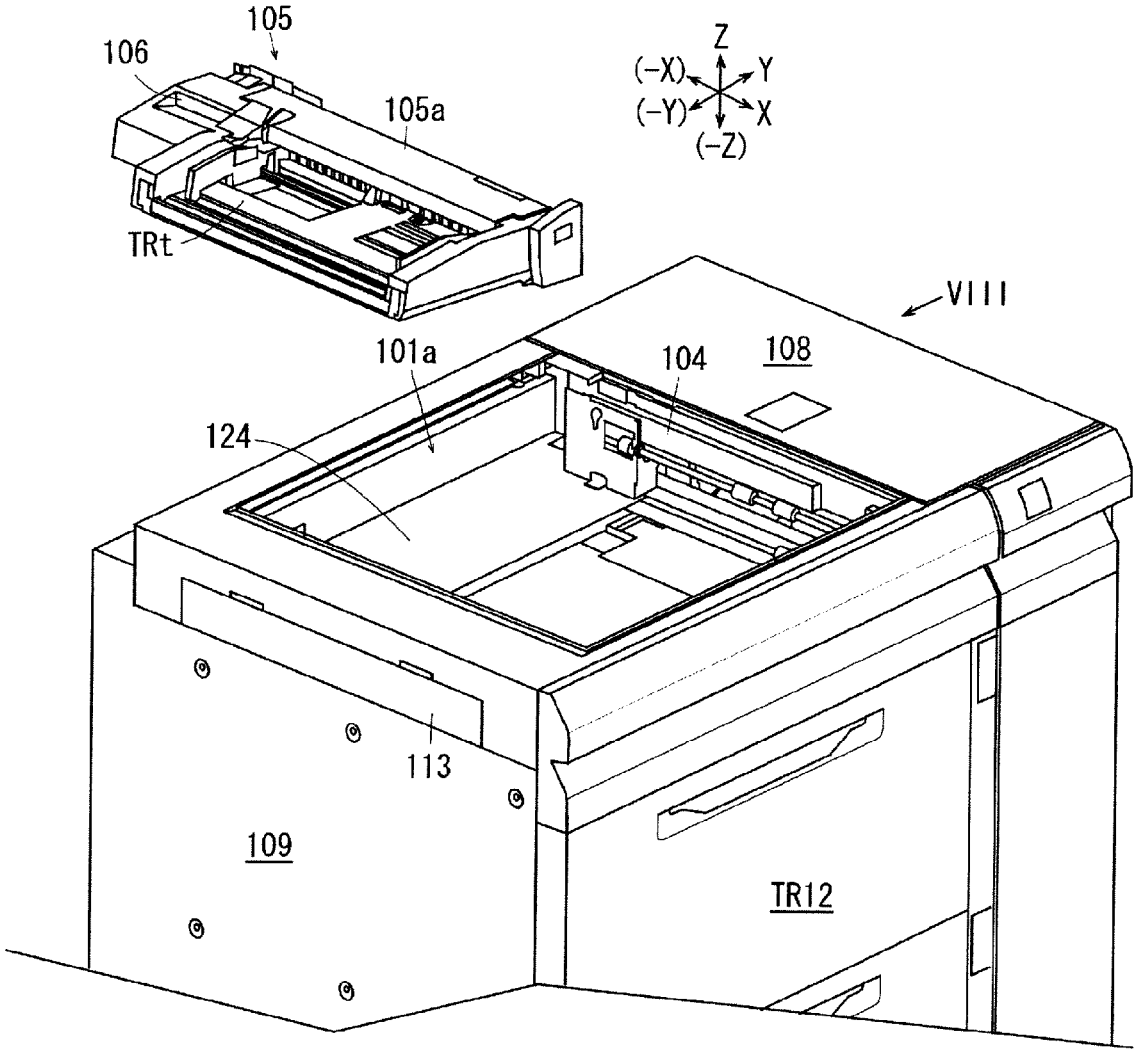
FIG. 7 is a perspective view showing a state where a hand-feeding unit is drawn out from the first feeding unit.

FIG. 7 is a perspective view showing a state in which the hand-feeding unit is drawn out from the first feeding unit.

Figures 8A, 8B:
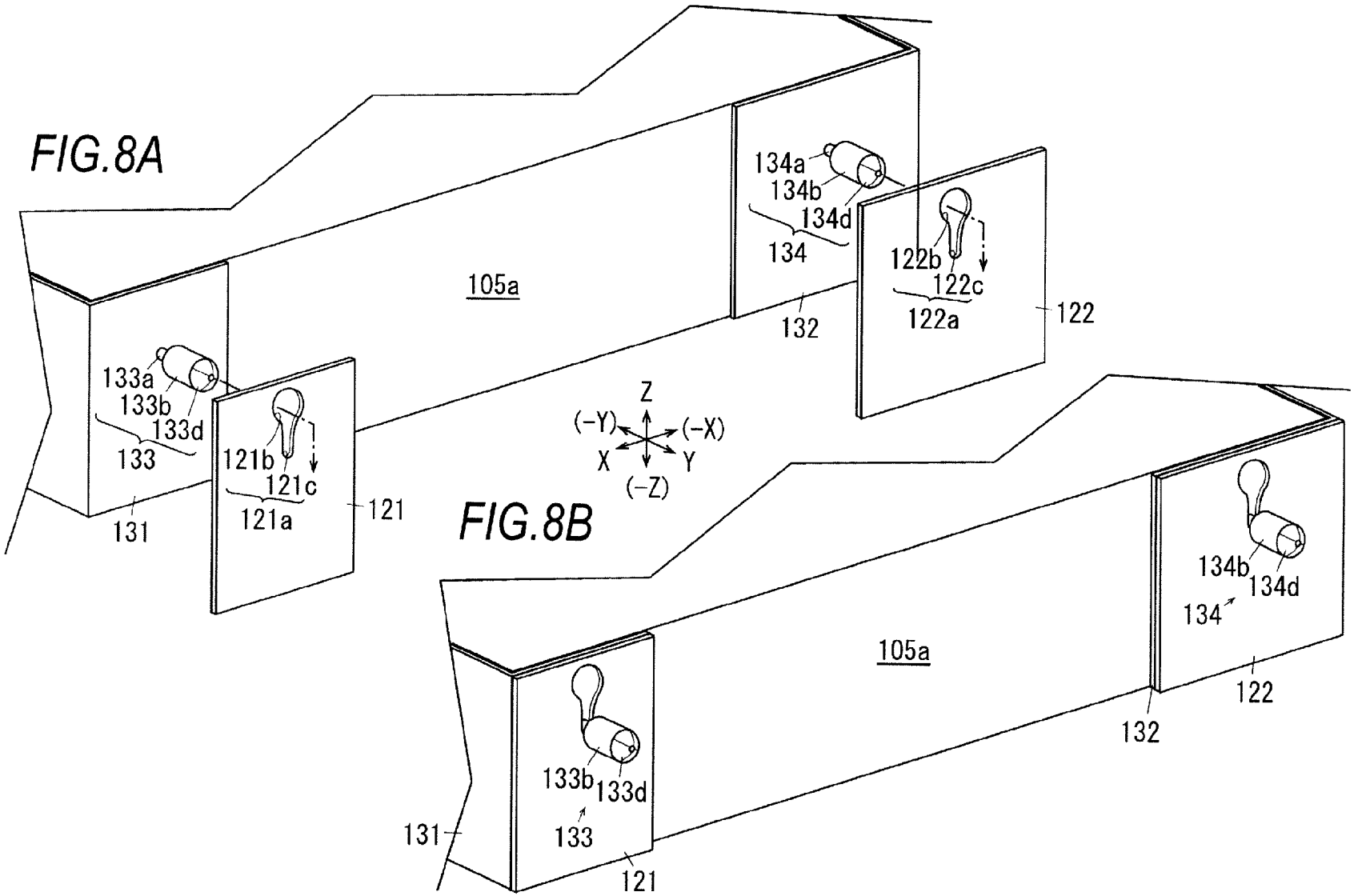
FIGS. 8A and 8B are an enlarged view showing the major parts observed in the direction of the arrow VIII in FIG. 7, where

FIGS. 8A and 8B are enlarged views of the parts when being observed in the direction of the arrow VIII in FIG. 7, wherein FIG. 8A is an enlarged view of the major parts in a state where the detaching projection portion is drawn out from the unit mounting hole, and FIG. 8B is an enlarged view of the major parts in a state where the detaching projection portion is mounted in the unit mounting hole.

In FIG. 7, a drive accommodating portion 106 in which a drive mechanism and control circuits, etc., (not illustrated) are accommodated is supported backward of the unit main body portion 105*a* in the hand-feeding unit 105 mounted in the hand-feeding-unit mounting portion 104. The hand-feeding pickup roll Rpt and the hand-feeding separation roll Rst of the hand-feeding unit 105 shown in FIG. 2 are driven by the drive mechanism of the drive accommodating portion 106.

In FIG. 7 and FIG. 8A, a pair of a front supported plate 131 and a backside supported plate 132 are supported at the right end part of the unit main body portion 105*a* and the drive accommodating portion 106. The detaching projection portion 133, which is disposed at a position corresponding to the unit mounting hole 121*a*, is supported at the right side of the front side supported plate 131. The detaching projection portion 133 has a columnar protrusion rod-shaped portion 133*a* the diameter of which is smaller than the diameter of the supporting hole portion 121*c*, and has, at the right end of the protrusion rod-shaped portion 133*a*, a detaching catch portion 133*b* the diameter of which is larger than that of the supporting hole portion 121*c* and is smaller than the detaching hole portion 121*b*. A mounting guiding portion 133*d* formed to be semi-spherical is formed at the right side of the detaching catch portion 133*b*. In addition, the length in the axial direction of the protrusion rod-shaped portion 133*a* is set to be slightly longer than the thickness of the front side unit mounting plate 121.

A detaching projection portion 134 constructed to be similar to the detaching projection portion 133 is supported at a position corresponding to the unit mounting hole 122*a* formed at the backside unit mounting plate 122 at the right side of the backside supported plate 132.

Figure 9:
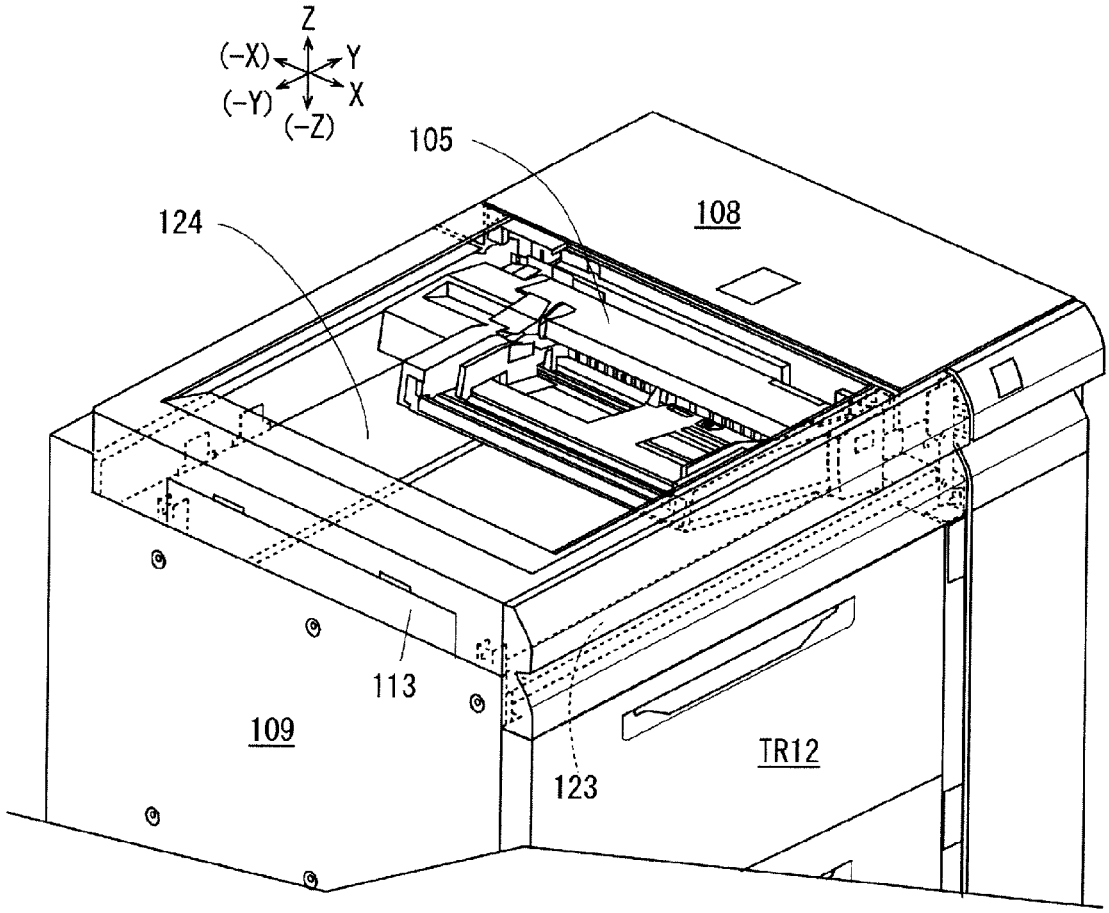
FIG. 9 is a perspective view showing a state where the hand-feeding unit is mounted in the first feeding unit.

FIG. 9 is a perspective view showing a state where the hand-feeding unit is mounted in the first feeding unit.

The detaching projection portions 133 and 134 of the hand-feeding unit 105 are moved toward the unit mounting holes 121*a* and 122*a*, as shown by the arrow of a one dot chain line in FIG. 8A, when mounting the hand-feeding unit 105 in the hand-feeding-unit mounting portion 104. At this time, the detaching projection portions 133 and 134 are guided by the mounting guiding portions 133*d* and 134*d* even if the centers of the mounting guiding portions 133*d* and 134*d* are slightly deviated from the detaching hole portions 121*b* and 122*b*, and the detaching catch portions 133*b* and 134*b* are passed through. And, when the hand-feeding unit 105 is moved downward, the protrusion rod-shaped portions 133*a* and 134*a* at the detaching projection portions 133 and 134 are moved downward along the supporting hole portions 121*c* and 122*c* as shown in FIG. 8B. In this state, movement thereof in the left and right direction is regulated by the detaching catch portions 133*b* and 134*b* the diameter of which is larger than that of the supporting hole portions 121*c* and 122*c*, wherein the hand-feeding unit 105 is retained with the protrusion rod-shaped portions 133*a* and 134*a* fitted in the supporting hole portions 121*c* and 122*c* by gravity. Therefore, as shown in FIG. 9, the hand-feeding unit 105 is mounted in the hand-feeding-unit mounting portion 104.

Figure 10:
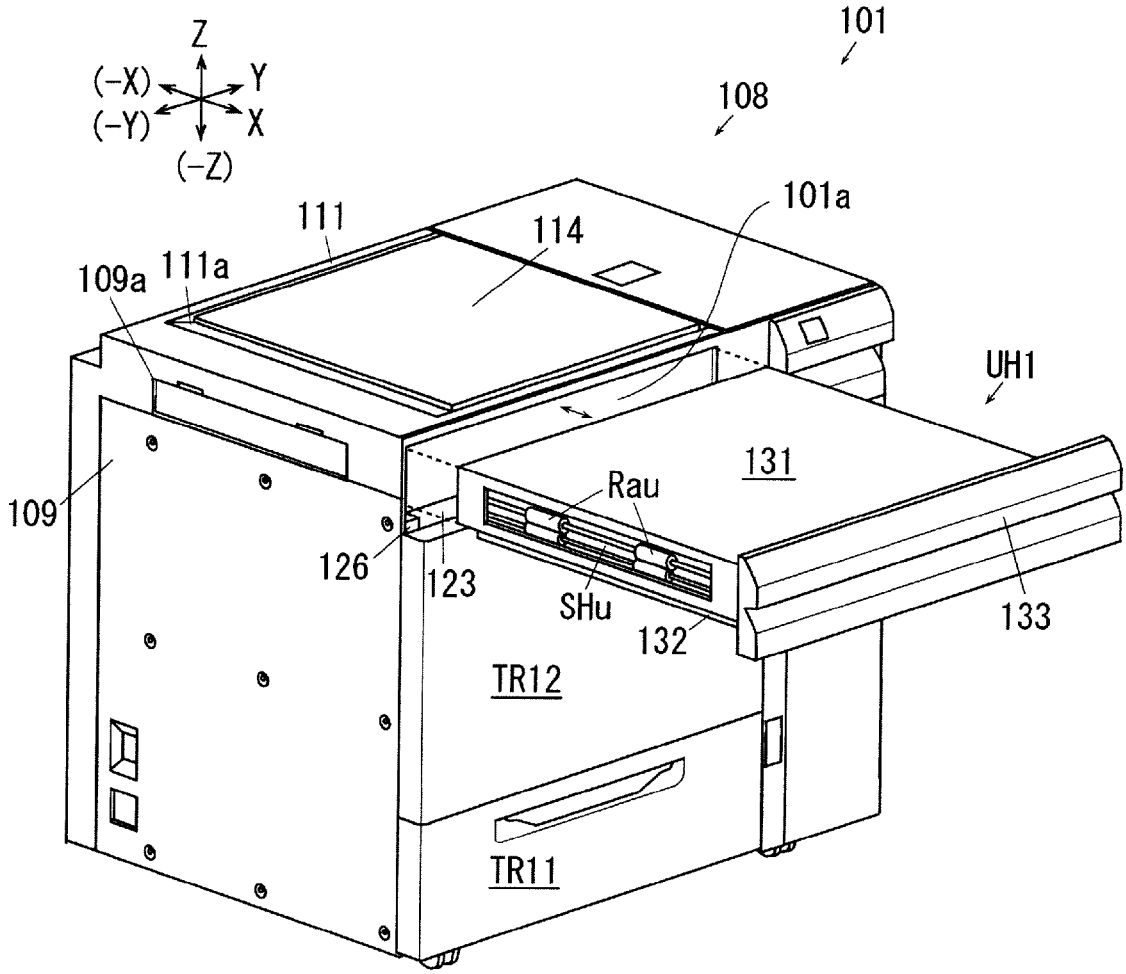
FIG. 10 is a perspective view showing a state where a conveyance path connection unit is drawn out from the first feeding unit.

FIG. 10 is a perspective view showing a state where the conveyance path connection unit is pulled out from the first feeding unit.

In FIG. 10, the passing hole cover 112 and the upper front cover 113, which are shown in FIG. 4, are removed from the first feeding unit 101. And, the conveyance path connection unit UH1 has a box-shaped unit main body portion 131 corresponding to the unit accommodating space 101*a*. A guided portion 132 guided by the guiding member 126 is provided at the left lower part of the unit main body portion 131. The connection conveyance path SHu extending in the left and right direction is internally formed in the unit main body portion 131, and a conveyance roll Rau as an example of the conveyance member is disposed in the connection conveyance path SHu. The conveyance roll Rau is driven and controlled by a drive mechanism and a control circuit, etc., which are not illustrated, installed in the connection conveyance path SHu. In addition, a gripping portion 133 formed to the same shape as that of the upper front cover 112 is provided at the front of the unit main body portion 131.

When mounting the conveyance path connection unit UH1 at the first feeding unit 101, such a state as shown in FIG. 10 is brought about, where the hand-feeding unit 105, the upper front cover 112, and the passing hole cover 113 are removed from the first feeding unit 101, and the unit accommodating hole cover 114 is mounted in the unit accommodating hole 111*a*. And, the conveyance path connection unit UH1 is inserted into the unit accommodating space 101*a* while matching the guided portion 132 to the guiding member 126. The inserted conveyance path connection unit UH1 is accommodated in the unit accommodating space 101*a* while being guided by the guiding member 126, and is supported by the front side unit supporting member 123 and the backside unit supporting member 124, which are shown in FIG. 6. And, the upstream end of the connection conveyance path SHu of the conveyance path connection unit UH1 is connected to the medium passing hole 109*a*, and the downstream end thereof is connected to the sheet feeding path SH14, wherein mounting of the conveyance path connection unit UH1 to the first feeding unit 101 is completed. Also, when pulling the conveyance path connection unit UH1 out of the first feeding unit 101, the gripping portion 133 of the conveyance path connection unit UH1 is held and is pulled out forward, wherein the conveyance path connection unit UH1 is pulled out from the first feeding unit 101 as shown in FIG. 7.

The second feeding unit 201 and the third feeding unit 301 have a configuration similar to that of the main body cover 108 of the first feeding unit, the unit accommodating space 101*a*, and the hand-feeding-unit mounting portion 104, etc. Since the hand-feeding unit 105 and the conveyance path connection unit UH2 are configured so as to be mountable as in the first feeding unit 101, detailed description thereof is omitted.

(Actions of Exemplary Embodiment 1)

In FIG. 2, where the sheet feeding unit U2 is composed of only the first feeding unit 101, recording sheets S accommodated in the sheet feeding trays TR11 and TR12 are conveyed to the sheet feeding path SH2 of the image forming apparatus main body U3, passing through the first medium conveyance portion 103. In addition, the recording sheets S accommodated in the hand-feeding tray TRt of the hand-feeding unit 105 are conveyed to the sheet feeding path SH2, passing through the hand-feeding path SH14 of the first medium conveyance portion 103, and is delivered after an image is recorded thereon in the image forming apparatus main body U3.

In FIG. 3, where the second feeding unit 201 and the third feeding unit 301 are additionally connected, that is, consecutively installed to the first feeding unit 101, the conveyance path connection unit UH1 is mounted at the hand-feeding-unit mounting portion 104 of the first feeding unit 101 instead of the hand-feeding unit 105. In addition, the conveyance path connection unit UH2 is mounted at the hand-feeding-unit mounting portion 204 of the second feeding unit 201. In the third feeding unit 301, the hand-feeding unit 105 is mounted at the hand-feeding-unit mounting portion 304. And, the downstream end of the confluence feeding path SH21 of the second feeding unit 201 is connected to the upstream end of the connection conveyance path SHu of the first feeding unit 101. Further, the downstream end of the confluence feeding path SH31 of the third feeding unit is connected to the upstream end of the connection conveyance path SHu' of the second feeding unit 201.

The sheet feeding unit U2 shown in FIG. 3 is thereby constructed. Where recording sheets S accommodated in the hand-feeding tray TRt of the hand-feeding unit 105 of the third feeding unit 301 or the sheet feeding trays TR31 and TR32 are fed, the recording sheet S is conveyed to the second feeding unit 201, passing through the confluence feeding path SH31 from the hand-feeding path SH34 or the feeding paths SH32 and SH33. The recording sheet S conveyed to the second feeding unit 201, in the second feeding unit 201, passes through the hand-feeding path SH24 from the connection conveyance path SHu', is conveyed through the confluence feeding path SH21, and is further conveyed to the first feeding unit 101. The recording sheet S conveyed to the first feeding unit 101, in the first feeding unit 101, passes through the hand-feeding path SH14 from the connection conveyance path SHu, is conveyed to the confluence feeding path SH11, and is further conveyed to the sheet feeding path SH2. That is, when being conveyed to the second feeding unit 201 and to the first feeding unit 101, the recording sheet S conveyed from the third feeding unit 301 is conveyed not by utilizing the conveyance path exclusive for medium feeding, through which recording sheets S from a consecutively installed feeding unit but by utilizing the existing hand-feeding paths SH14 and SH24, through which the recording sheets S from the hand-feeding tray TRt are conveyed, where the hand-feeding unit 105 is mounted. Similarly, the recording sheets S in the sheet feeding trays TR21 and TR22 of the second feeding unit 201 are conveyed from the feeding paths SH22 and SH23 to the first feeding unit 101, passing through the confluence feeding path SH21, and in the first feeding unit 101, the recording sheets S pass through the existing hand-feeding path SH14 from the connection conveyance path SHu, are conveyed to the confluence feeding path SH11, and are further conveyed to the sheet feeding path SH2.

Exemplary Embodiment 2

Figure 11:
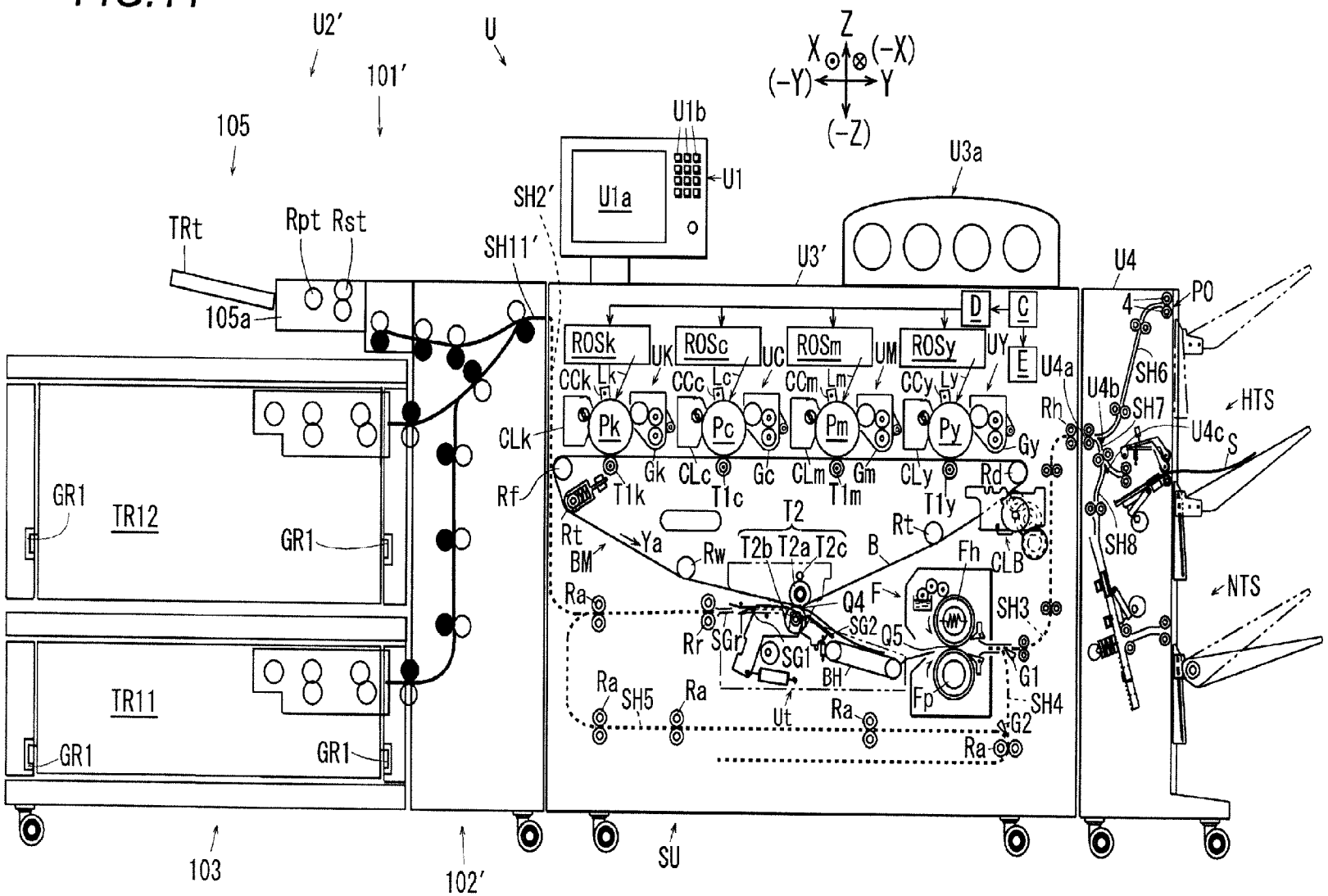
FIG. 11 is a schematic view showing the entirety of an image forming apparatus according to exemplary embodiment 2, which corresponds to FIG. 2 of exemplary embodiment 1.

FIG. 11 is a schematic view of the entirety of an image forming apparatus according to exemplary embodiment 2, which corresponds to FIG. 2 of exemplary embodiment 1.

Figure 12:
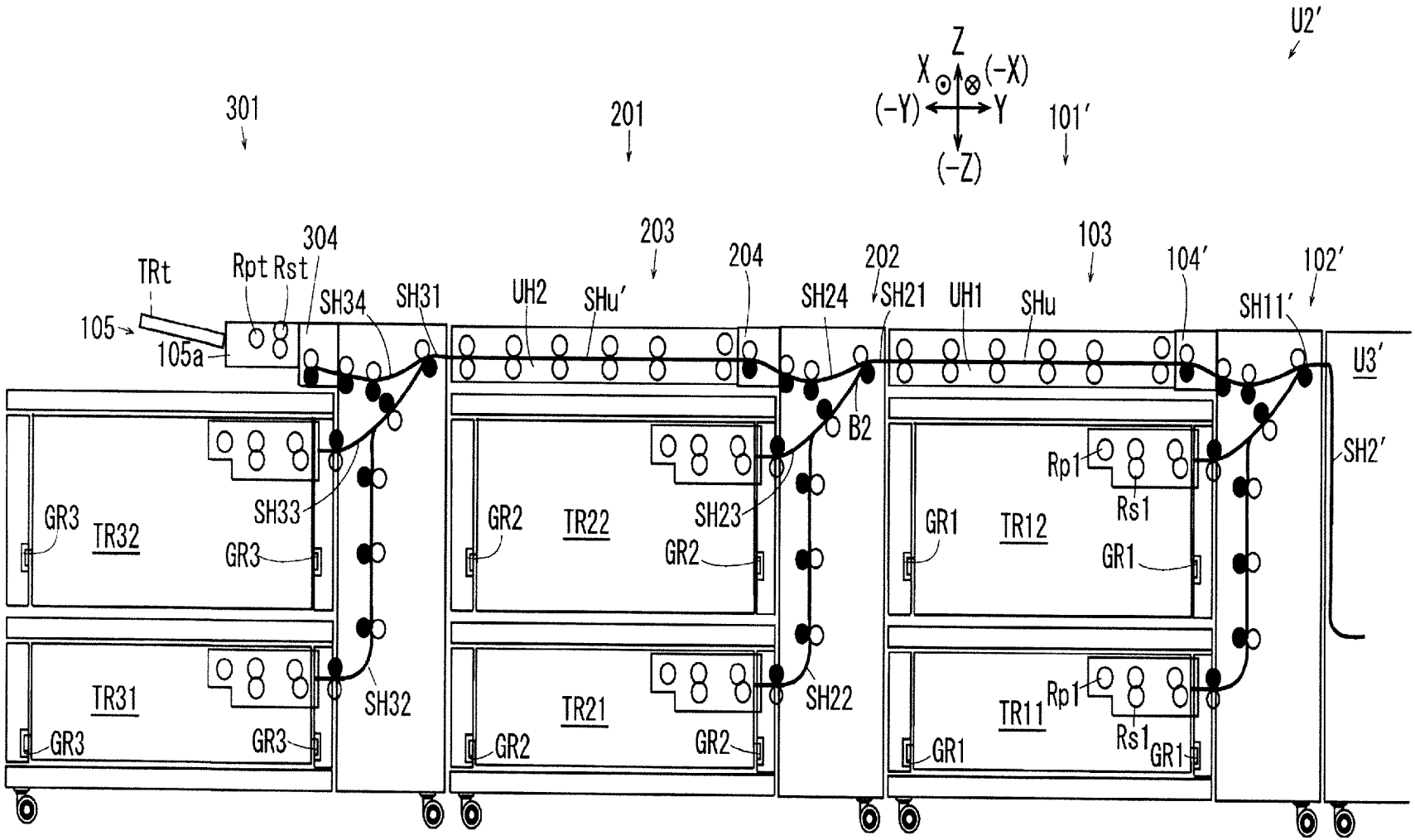
FIG. 12 is a schematic view showing a case where the sheet feeding unit according to exemplary embodiment 2 includes a plurality of feeding units, which corresponds to FIG. 3 of exemplary embodiment 1.

FIG. 12 is a schematic view showing a case where a sheet feeding unit according to exemplary embodiment 2 has a plurality of feeding units, which corresponds to FIG. 3 of exemplary embodiment 1.

Next, a description is given for exemplary embodiment 2. In the description of exemplary embodiment 2, components that correspond to the components of exemplary embodiment 1 are given the same reference symbols, and detailed description thereof is omitted.

Although the present exemplary embodiment differs from the exemplary embodiment 1 in the following points, the present exemplary embodiment is constructed as in exemplary embodiment 1 in the other points.

In FIG. 11 and FIG. 12, in an image forming apparatus main body U3' according to exemplary embodiment 2, a sheet feeding path SH2' as an example of a carrying-in path by which recording sheets S are fed from the upper left part of the image forming apparatus main body U3' is formed instead of the sheet feeding path SH2 by which recording sheets S are fed from the middle left side of the image forming apparatus main body U3 according to exemplary embodiment 1. Also, the sheet feeding unit U2' according to exemplary embodiment 2 includes the first feeding unit 101' having the first medium conveyance portion 102' constructed to be similar to the second medium conveyance portion 202 instead of the first feeding unit 101 according to exemplary embodiment 1. That is, the medium feeding units 101', 201 and 301 of the sheet feeding unit U2' according to exemplary embodiment 2 are made common, and are configured to be similar to each other, except that the units mounted in the hand-feeding-unit mounting portions 104', 204 and 304 differ.

(Actions of Exemplary Embodiment 2)

In exemplary embodiment 2, when recording sheets S accommodated in respective trays TR11 through TR32 and TRt are fed, the sheets S pass through the confluence feeding path SH11' formed upward in the first medium conveyance portion 102' of the first feeding unit 101' and are conveyed to the sheet feeding path SH2'. And, the sheets S are delivered after images are recorded thereon in the image forming apparatus main body U3'

MODIFIED EXAMPLE

As described above, although a detailed description was given for the present invention, the present invention is not limited to the exemplary embodiments described above, and may be subjected to various modifications and variations within the scope of the spirit of the present invention, which is described in Claims thereof. Modified examples (H01) through (H05) of the present invention will be exemplified below.

(H01) In the respective exemplary embodiments described above, a printer U is exemplified as an example of an image forming apparatus, however, the present invention is not limited thereto, and may be applicable to a copy machine, a facsimile machine, or a multi-functional machine etc., provided with a plurality of these functions. Also, the present invention is not limited to an electro-photography type image forming apparatus, and may be applicable to an optional type of image forming apparatus of not only an ink jet type recording system and a thermal head type system but also a printer such as a lithography type, etc. Furthermore, the present invention is not limited to a multi-color development type image forming apparatus, and may be configured by a single color type, a so-called monochrome image forming apparatus.

(H02) In the exemplary embodiments described above, recording sheets S are fed with the first feeding unit 101 or 101' connected to the image forming apparatus main body U3 or U3', respectively. However, the present invention is not limited thereto. For example, such a configuration may be possible, in which the hand-feeding unit 105 is constructed so as to be detachably mounted in the image forming apparatus main body U3 and U3', and recording sheets S are fed directly to the image forming apparatus main body U3 and U3' by the hand-feeding unit 105, or a medium feeding unit is consecutively installed, in the form of addition, at the image forming apparatus main body in which the medium accommodating portion is integrally formed.

(H03) Although, in the respective exemplary embodiments described above, the respective medium feeding units are composed of two stages of sheet feeding trays of an upper stage and a lower stage, however, the medium feeding units are not limited thereto, and may be composed of three or more stages or, on the contrary, of only one stage of tray.

(H04) Although, in the respective exemplary embodiments described above, the respective medium feeding units are composed so that the lower stage of sheet feeding tray is made smaller than the upper stage of sheet feeding tray, the medium feeding units are not limited thereto, wherein any optional combinations may be acceptable in which the lower stage of the sheet feeding tray is made larger than the upper stage of the sheet feeding tray or the sizes of the upper and lower stages of the sheet feeding trays are made the same.

(H05) Although, in the respective exemplary embodiments described above, the respective sheet feeding units U2 and U2' are composed of one or three medium feeding units, the sheet feeding units are not limited thereto, wherein the sheet feeding units U2 and U2' may be configured so that two or four or more medium feeding units are consecutively installed.

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. An image forming apparatus, comprising:

an image recording device that includes a carrying-in path into which a medium is carried in and forms an image on the medium;

a first feeding unit comprising:

a first accommodating portion that accommodates a medium;

a first conveyance path that extends from the first accommodating portion and is connected to the carrying-in path for conveying the medium from the first accommodating portion;

a first mounting portion that includes a first hand-feeding conveyance path, wherein a hand-feeding unit is detachably mounted to the first mounting portion, the hand-feeding unit comprises a hand-feeding accommodating portion in which a hand-fed medium is to be accommodated, and the first hand-feeding conveyance path connects the hand-feeding accommodating portion and the carrying-in path for conveying the hand-fed medium from the hand-feeding accommodating portion;

a connection unit for consecutive installation, that is configured to be detachably mounted to the first mounting portion in a state where the hand-feeding unit is removed from the first mounting portion, and includes an added conveyance path therein for consecutive installation to be connected to the first hand-feeding conveyance path; and a second feeding unit comprising:

a second accommodating portion that accommodates a medium;

a second conveyance path that extends from the second accommodating portion and is connected to the added conveyance path for conveying the medium from the second accommodating portion; and a second mounting portion that includes a second hand-feeding conveyance path, wherein the hand-feeding unit is detachably mounted to the second mounting portion, and the second hand-feeding conveyance path is connected to the added conveyance path for conveying a medium from the hand-feeding accommodating portion.

2. A medium feeding unit, comprising:

a first feeding unit comprising:

a first accommodating portion that accommodates a medium;

a first conveyance path that extends from the first accommodating portion and is connected to a carrying-in path for conveying the medium from the first accommodating portion;

a first mounting portion that includes a first hand-feeding conveyance path, wherein a hand-feeding unit is detachably mounted to the first mounting portion, the hand-feeding unit comprises a hand-feeding accommodating portion in which a hand-fed medium is to be accommodated, and the first hand-feeding conveyance path connects the hand-feeding accommodating portion and the carrying-in path for conveying the hand-fed medium from the hand-feeding accommodating portion;

a connection unit for consecutive installation, that is configured to be detachably mounted to the first mounting portion in a state where the hand-feeding unit is being removed from the first mounting portion, and includes an added conveyance path therein for consecutive installation to be connected to the first hand-feeding conveyance path; and a second feeding unit comprising:

a second accommodating portion that accommodates a medium;

a second conveyance path that extends from the second accommodating portion and is connected to the added conveyance path for conveying the medium from the second accommodating portion; and a second mounting portion that includes a second hand-feeding conveyance path, wherein the hand-feeding unit removed from the first mounting portion is detachably mounted to the second mounting portion, and the second hand-feeding conveyance path is connected to the added conveyance path for conveying a medium from the hand-feeding accommodating portion.

3. The medium feeding unit according to claim 2, wherein the upstream end of the carrying-in path and the downstream end of the first conveyance path, and the upstream end of the added conveyance path and the downstream end of the second medium conveyance path are located at substantially the same level in the gravity direction, and the first medium feeding unit and the second medium feeding unit have the same constitution.

4. The medium feeding unit according to claim 2, wherein the connection unit is insertably and removably supported to the first feeding unit along the vertical direction of a medium conveyance direction of the added conveyance path in a horizontal plane.

5. The medium feeding unit according to claim 2, further including:

a second connection unit for consecutive installation, that is configured to be detachably mounted to the second mounting portion in a state where the hand-feeding unit is removed from the second mounting portion, and includes a second added conveyance path therein for consecutive installation to be connected to the second hand-feeding conveyance path; and a third feeding unit comprising:

a third accommodating portion that accommodates a medium;

a third conveyance path that extends from the third accommodating portion and is connected to the second added conveyance path for conveying the medium from the third accommodating portion; and a third mounting portion that includes a third hand-feeding conveyance path, wherein the hand-feeding unit removed from the first mounting portion or the second mounting portion is detachably mounted to the third mounting portion, the third hand-feeding conveyance path is connected to the second added conveyance path for conveying a medium from the hand-feeding accommodating portion.

* * * * *